US006339881B1

(12) United States Patent
Fisher et al.

(10) Patent No.: US 6,339,881 B1
(45) Date of Patent: Jan. 22, 2002

(54) INK JET PRINTHEAD AND METHOD FOR ITS MANUFACTURE

(75) Inventors: Almon P. Fisher; Peter J. John, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/971,645

(22) Filed: Nov. 17, 1997

(51) Int. Cl.[7] ..... B21D 53/76; B41J 2/05

(52) U.S. Cl. ..... 29/890.1; 29/611; 347/56; 347/61; 347/47; 347/49; 156/89.12

(58) Field of Search ..... 29/890.1, 611, 29/25.35; 347/26, 56, 61, 47, 49; 156/89.12, 293, 304.2

(56) References Cited

U.S. PATENT DOCUMENTS

| | | | | | |
|---|---|---|---|---|---|
| RE32,572 | E | | 1/1988 | Hawkins et al. | |
| 4,789,425 | A | | 12/1988 | Drake et al. | |
| 4,822,755 | A | * | 4/1989 | Hawkins et al. | 437/227 |
| 4,829,324 | A | | 5/1989 | Drake et al. | |
| 4,851,371 | A | | 7/1989 | Fisher et al. | |
| 4,935,750 | A | | 6/1990 | Hawkins | |
| 5,097,274 | A | * | 3/1992 | Drake et al. | 29/890.1 |
| 5,194,877 | A | * | 3/1993 | Lam et al. | 29/890.1 |
| 5,218,754 | A | | 6/1993 | Rangappan | |
| 5,297,331 | A | * | 3/1994 | Childers | 29/890.1 |
| 5,297,336 | A | * | 3/1994 | Burolla | 29/890.1 |
| 5,333,007 | A | * | 7/1994 | Kneezel et al. | 29/890.1 |
| 5,450,109 | A | * | 9/1995 | Hock | 29/890.1 |
| 5,519,425 | A | * | 5/1996 | Dietl et al. | 347/87 |
| 5,565,901 | A | * | 10/1996 | Hawkins | 347/49 |
| 5,588,597 | A | * | 12/1996 | Reinecke et al. | 347/47 |
| 5,617,631 | A | | 4/1997 | Nguyen | |
| 5,665,249 | A | * | 9/1997 | Burke et al. | 29/890.1 |
| 5,751,316 | A | * | 5/1998 | Bailey et al. | 29/890.1 |
| 5,755,024 | A | * | 5/1998 | Drake et al. | 29/611 |
| 5,870,120 | A | * | 2/1999 | Terai | 29/890.1 |

FOREIGN PATENT DOCUMENTS

| | | | | |
|---|---|---|---|---|
| JP | 2-102056 | * | 4/1990 | 29/890.1 |
| JP | 5-24204 | * | 2/1993 | 29/890.1 |
| JP | 6-31914 | * | 2/1994 | 29/890.1 |

OTHER PUBLICATIONS

Laser–Trimmable Serial Compensation Resistor Design for Thermal Ink Jet Header Arrays, IBM Technical Disclosure Bulletin, vol. 35, No. 1A, pp. 412–419, Jun. 1992.*

* cited by examiner

*Primary Examiner*—Lee Young
*Assistant Examiner*—A. Dexter Tugbang
(74) *Attorney, Agent, or Firm*—Fay, Sharpe, Fagan, Minnich & McKee, LLP

(57) ABSTRACT

A method of fabricating a printhead for use in an ink jet printing device which includes providing a substrate having at least one substantially planar surface. An array of heating elements are formed on the surface of the substrate and addressed with a current pulse from an electrode. Depositing an insulating layer over the surface. Next, the insulating layer is mechanically or chemically treated to expose the heating elements. An ink channel plate is formed and includes at least one ink reservoir and one ink channel. A key or keyway is formed on channel plate and a corresponding key or keyway is formed on the insulating layer. The said channel plate is then adhesively secured to the substrate using the key and keyway as an alignment aid to achieve proper positioning of the ink channels and the heating elements.

9 Claims, 3 Drawing Sheets

FIG. 5
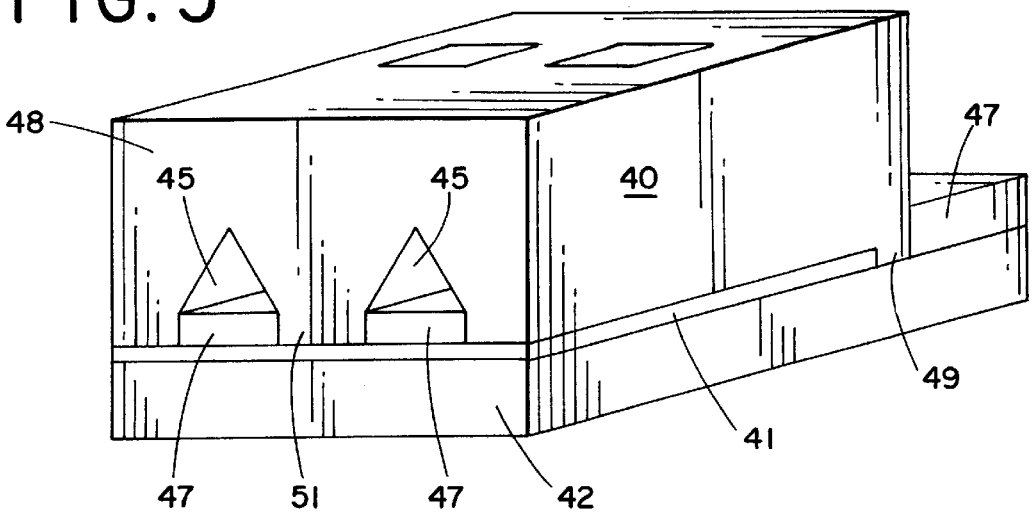
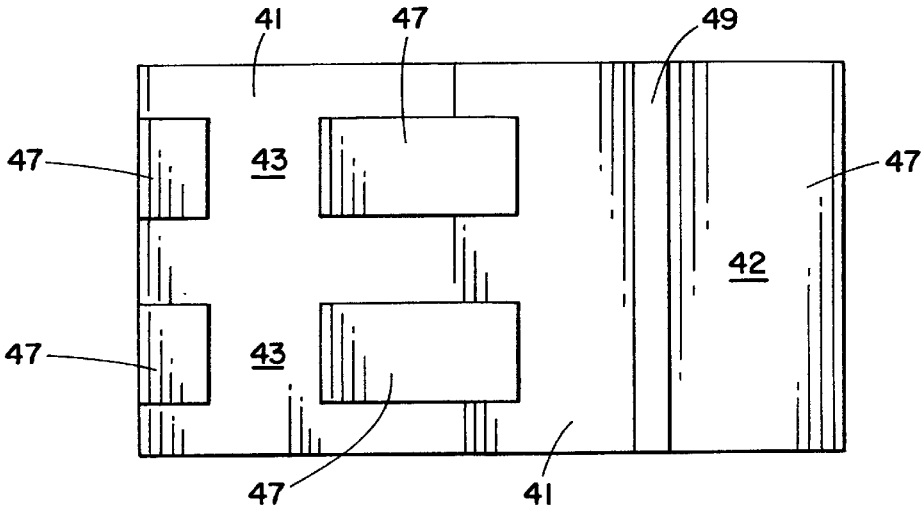
FIG. 7
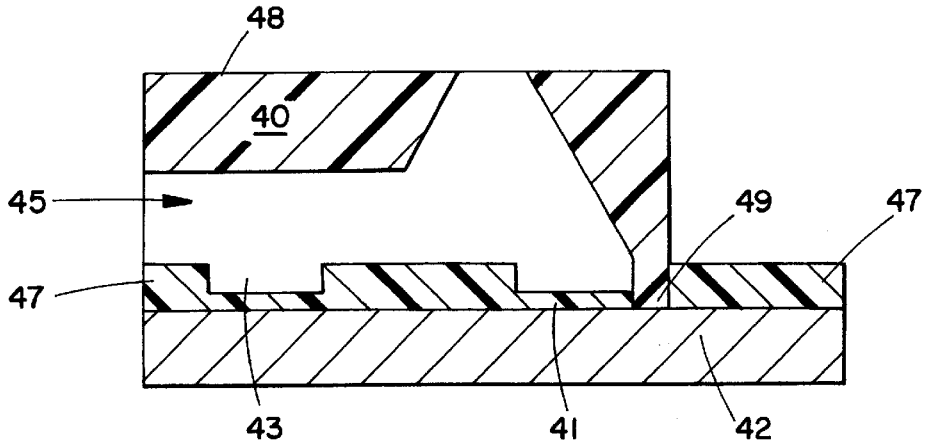
FIG. 6

INK JET PRINTHEAD AND METHOD FOR ITS MANUFACTURE

BACKGROUND OF THE INVENTION

This invention relates to an ink jet printhead. More particularly, this invention relates to a thermal ink jet printhead and an improved process for it's fabrication.

Generally, the ink jet printing systems to which the subject invention relates are divided into either thermal ink jet type or bubble ink jet type. Typically, a thermal ink jet printhead is comprised of one or more ink-filled channels communicating with a small ink supply chamber at one end and having an opening at the opposed end, referred to as a nozzle. A thermal energy generator, usually a resistor, is located in each channel near the nozzle at a predetermined distance therefrom. The resistors are individually addressed with a current pulse to momentarily vaporize the ink and form a bubble. As the bubble grows, the ink bulges from the nozzle and is contained by the surface tension of the ink to form a meniscus. As the bubble begins to collapse, ink still in the channel between the nozzle and the bubble starts to move toward the collapsing bubble causing a volumetric contraction of the ink at the nozzle, resulting in separation of the bulging ink as a droplet. The acceleration of the ink out of the nozzle while the bubble is growing provides a momentum and velocity to the droplet in substantially a straight line in the direction of a recording medium, such as a sheet of paper. U.S. Pat. Nos. 4,463,359; 4,849,774 and 5,192,959 describe this type of system and are herein incorporated by reference.

A preferred technique for the manufacture of thermal ink jet printheads is the joining of two substrates, a first forming the ink channels and a second containing the heating electrodes to form a complete printhead. For example, U.S. Pat. No. Re. 32,572, herein incorporated by reference, discloses a method of forming a plurality of ink jet printheads of two silicon wafers. A plurality of sets of heating elements and their individually addressed electrodes are formed on a surface of one of the wafers and a corresponding plurality of parallel channels, each channel communicating with a manifold, are anistropically etched in a surface of the other wafer. A fill hole and alignment openings are etched in the opposed surface of the channeled wafer. Alignment marks are formed at predetermined locations on the wafer surface having the heating elements. The wafer surface with the channels is aligned with the heating elements via the alignment openings and alignment marks and the wafers are bonded together. A plurality of individual printheads are obtained by dicing the two aligned bonded wafers.

Each printhead is then fixedly positioned on the edge of an electrode or daughter board so that the channel nozzles are parallel to the daughter board edge. The printhead electrodes are wire-bonded to corresponding electrodes on the daughter board. The daughter board with printheads is mounted on an ink supply cartridge. Obviously, to function adequately, it is essential that each heating element and ink channel align precisely. As a review of the manufacturing process disclosed in the Re.32,572 patent will show, a primary emphasis in printhead manufacture is obtaining appropriate alignment of the individual component pieces.

SUMMARY OF THE INVENTION

Accordingly, it is a primary object of this invention to provide a new and improved thermal ink jet printhead.

It is an advantage of this invention to provide a new and improved printhead that is manufactured by a process which assures dependable alignment of a first ink channel substrate and a second heating element substrate.

Additional objects and advantages of the invention will be set forth in part in the description which follows and in part will be obvious from the description, or may be learned by practice of the invention. The objects and advantages of the present invention may be realized and attained by means of the instrumentalities and combinations particularly pointed out in the appended claims.

To achieve the foregoing objects and in accordance with the purpose of the invention, as embodied and broadly described herein, the thermal ink jet printhead of this invention comprises a first ink channel containing substrate bonded to a second heating unit containing substrate wherein appropriate alignment of the heating units with their respective ink channels is achieved via cooperative key and keyway elements formed in the two substrates. The invention is applicable to both the printhead and the wafer scale. Moreover, the use of the key-keyway mating system can be used during the mating of wafers prior to any necessary dicing operation or may be used to mate the heater element and ink channel element of individual printheads.

In a preferred embodiment, the mating surfaces of the ink channel substrate and the heater unit containing substrate are substantially coplanar and include a first linear keyway channel, a second linear keyway channel perpendicular to the first, a first mating key ridge and a second mating key ridge perpendicular to the first, the key ridges being cooperative with the keyway channels.

In an alternative form, one of the substrates is formed to include lateral sidewalls or a rear wall which overlaps the corresponding sidewall of the other substrate and provides side-to-side and/or front to back alignment. This form of the invention can be used in addition to the keyway channel-key ridge elements or as a replacement therefore.

The inventive printhead of the present invention is manufacturable via a procedure comprising the steps of: (a) providing a first heating element substrate having at least one generally planar surface; (b) forming an array of heating elements on the planar surface and forming a pattern of electrodes on the substrate for enabling the individual addressing of each heating element; (c) depositing an insulation layer on the planar surface; (d) photo-patterning the insulating layer to expose the heating element; (e) forming an ink channel substrate having at least an ink reservoir and an ink channel; (f) forming a key on the ink channel substrate and a corresponding keyway on the heating element substrate to provide an alignment mechanism; and (g) adhesively securing the ink channel substrate to the heating element substrate using the alignment mechanism to achieve proper positioning of the ink channel(s) and heating elements.

In a particularly preferred form of the invention, the ink channel plate is a molded plastic piece formed according to the process comprising constructing a silicon preform of the desired shape, electroplating the silicon preform with a metal such as nickel to form a metal die, and molding the plastic channel substrate in the metallic die. This procedure is more fully described in U.S. Pat. No. 5,617,631, herein incorporated by reference.

BRIEF DESCRIPTION OF THE DRAWINGS

The invention consists in the novel parts, construction, arrangements, combinations and improvements shown and described. The accompanying drawings, which are incorporated in and constitute a part of this specification illustrate one embodiment of the invention and, together with the description, serve to explain the principles of the invention.

FIG. 5 is a perspective view of an alternative embodiment of the inventive printhead;

FIG. 6 is a cross-sectional view of the printhead of FIG. 5; and

FIG. 7 is a top view of the heater substrate of FIG. 5.

DETAILED DESCRIPTION OF THE INVENTION

Reference will now be made in detail to the present preferred embodiment of the invention, an example which is illustrated in the accompanying drawings.

While the invention will be described in connection with the preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
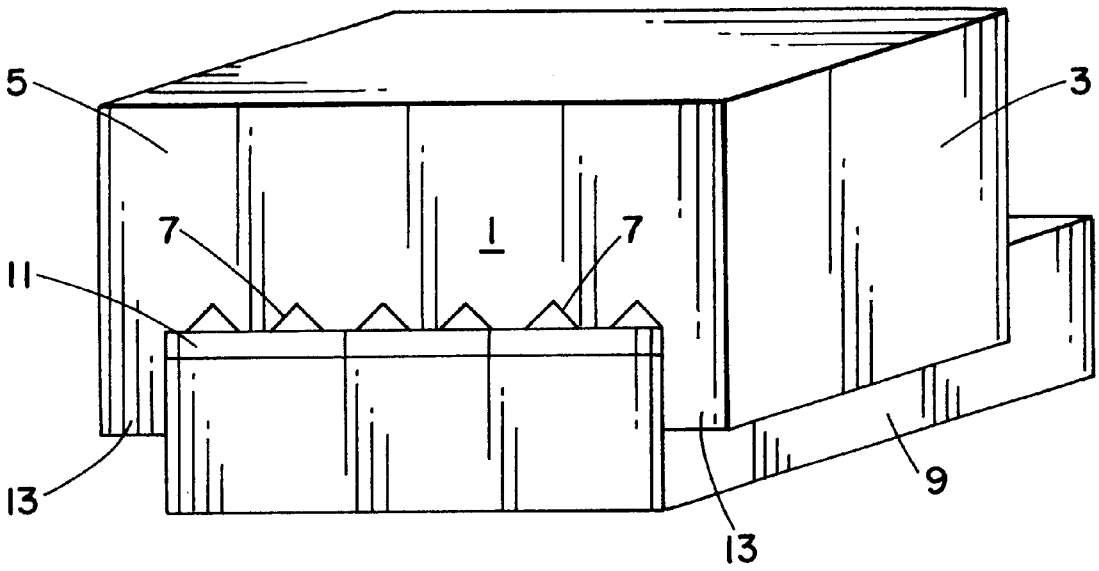
FIG. 1 is a perspective view of an individual thermal ink jet printhead.
Figure 2:
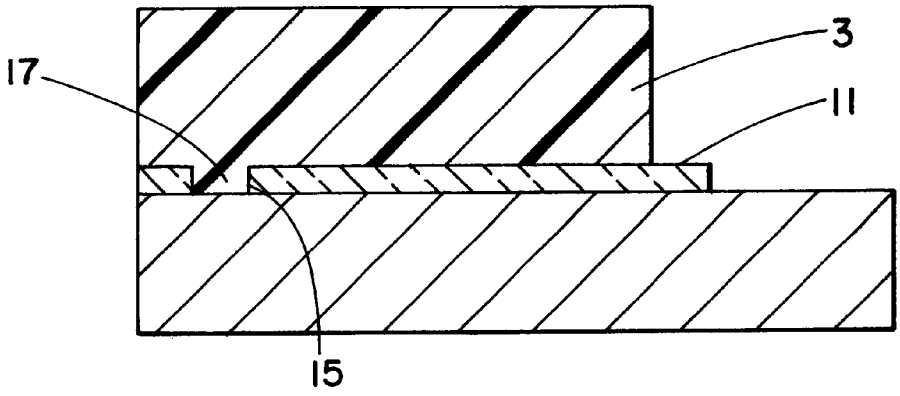
FIG. 2 is a cross-sectional view of the printhead of FIG. 1.

FIGS. 1 and 2 represent a printhead 1 including a substrate 3 having a front face 5 with jet nozzles 7 formed therein. Preferably, the substrate 3 is a molded plastic part. A heater substrate 9 is also provided, and in its finished state will include heating elements 10, as more fully described in U.S. Pat. No. 4,851,371, herein incorporated by reference. An insulation layer 11 forms a patterned interface between the plastic substrate 3 and the heater substrate 9. This insulation layer, preferably of polyimide is a pasivation layer which protects the electronic circuitry from mobile ions and ink.

The inventive alignment mechanism of the present invention is depicted in the perspective view wherein overhanging sides 13 (key) of the substrate 3 form a lateral alignment means with the lateral walls (keyway) heater substrate 9. In addition, as best seen in FIG. 2, a groove 15 (keyway) is formed in the insulation layer 11 and a cooperative mating ridge 17 (key) is formed in the substrate 3. In this manner, front to back alignment is provided. This alignment mechanism is particularly beneficial in the manufacture of individual printheads. More particularly, appropriately molded plastic substrates or etched silicon substrates can be accurately mated—either clipped or adhesively secured together—as a result of the provided key-keyway system.

Preferably, the substrate is formed of a polyimide, polyurethane, polyvinyl acetate, mylar or other thermoplastic polymeric material as known to those skilled in the art. The heater substrate is preferably constructed of silicon. Of course, the materials are not limited to those identified and may include any of those known to one of ordinary skill in the art.

Figure 3:
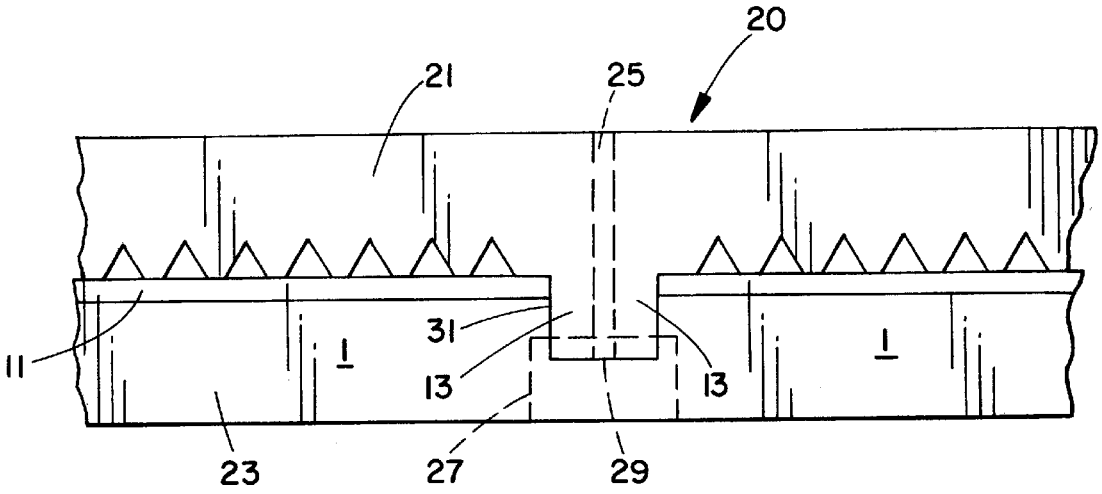
FIG. 3 is a front view of a wafer and the dicing locations which provide for front-to-back separation into individual units.
Figure 4:
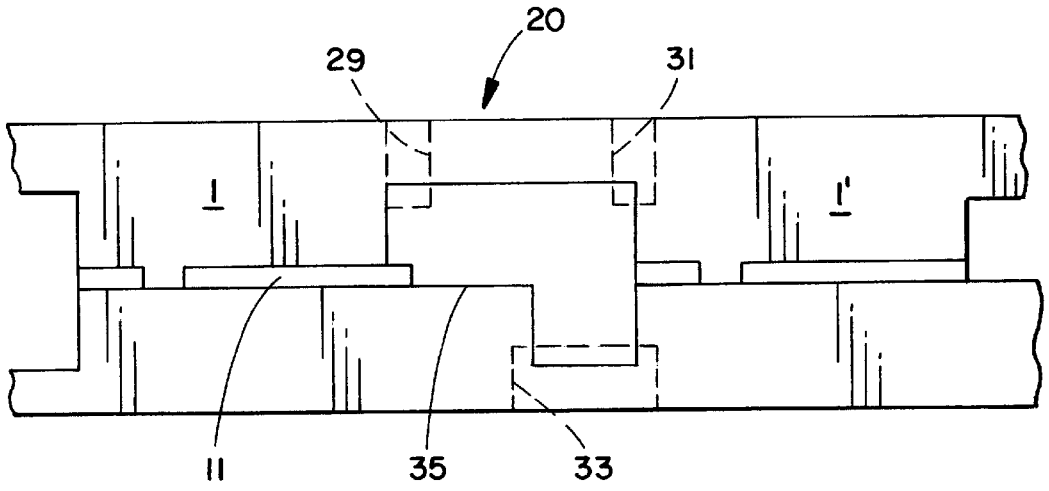
FIG. 4 is a side view of the wafer and the dicing location which provide side-to-side separation.

Referring now to FIGS. 3 and 4, the application of the invention to wafer scale production is evidenced. Particularly, in the preferred method of manufacture, the individual printhead 1 is formed by constructing a laminate 20 of a monolithic ink channel wafer 21 which is bonded to a monolithic heater wafer 23 and alignment is achieved again by mating ridges (keys) and recesses (keyways) in the two wafers. After adhesively joining the wafers, they are diced according to procedures noted in U.S. Pat. Nos. 5,218,754; 4,789,425; and 4,829,324, herein incorporated by reference. The dicing operation includes a cut 25 through the plastic wafer and provides an overhanging alignment (key-keyway) structure 13 as shown more clearly in FIG. 1. More specifically, the ridge-recess arrangement in the wafer scale becomes the overhanging sidewall alignment in the printhead unit. A second, back side dicing cut 27 is provided for the final separation. Also demonstrated in this view is the use of a notch 29 and groove 31 in the ink channel wafer 21 and the insulation layer of the heater wafer 23 respectively, to obtain alignment of the wafers.

Referring specifically to FIG. 4, the side profile of the wafer laminate 20 is shown including the locations of the dicing cuts necessary to complete the separation of the wafer into individual unit 1. More particularly, top side dicing cuts 29 and 31 are made in addition to a bottom side dicing cut 33. This will provide both an electrical bonding pad area 35 on a first printhead unit 1 and a second unit 1'.

Turning now to FIGS. 5, 6 and 7, an alternative embodiment of the inventive printhead 40 is depicted wherein the alignment mechanism (key-keyway) are provided based solely on the photoetching of the insulation layer 41 and 47 in both side to side and front to back manners. More particularly, a thin polyimide layer 41 and a thick polyimide layer 47 are provided to create both an ink reservoir area 43 and a nozzle opening 45 in compilation with the upper ink channel substrate 48. Particularly, the printhead 40 includes a rear key-keyway arrangement 49 which provides a front to back alignment mechanism and lengthwise key-keyway arrangements 51. In this regard, definitive alignment of the upper ink channel substrate 48 and the lower heating substrate 42 is obtained with respect to the printhead unit product. This consistent manufacture of the individual print head modules results in a greater assurance that an assembled printhead will include properly aligned ink jet nozzles.

In summary, the invention provides a good way of manufacturing thermal ink jet printheads by using a mechanical self aligning structure which insures proper alignment of the ink channels and heater elements during fabrication. Particularly, a keyway is preferably fabricated using photo patterning or mechanical etching in the insulation layer of a silicon heater substrate. A molded plastic ink channel is provided with alignment keys to provide an element i.e., a side wall that overhangs the precision diced edges on the silicon heater unit. Front to back alignment is achieved when a plastic ridge in the channel array fits into the keyway in the polyimide on the heater substrate. Wafer scale assembly of multiple arrays of dies is achieved by group dicing the precision edges in the heater wafer rather than section dicing.

Due to the thermal expansion mismatch typically experienced between plastic and silicon the channel size and the alignment should be optimized for the device operating temperature, and consequently the temperature when making the alignment between the plastic multiple channel array and the silicon heater wafer should be the device operating temperature.

The dicing cuts used to separate the dye can be performed with a metal type dicing plate at high feed rates. They do not require expensive dicing equipment when compared with equipment required for nozzle dicing.

Thus, it is apparent that there has been provided, in accordance with the invention a thermal ink jet printhead and a method of its manufacture that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method of fabricating a printhead for use in an ink jet printing device comprising the steps of:

a) providing a substrate having at least one substantially planar surface;

b) forming an array of heating elements on said surface and forming electrodes on said substrate for enabling addressing of each heating element;

c) depositing an insulating layer on said planar surface;

d) treating said insulating layer to expose said heating elements;

e) forming an ink channel plate having at least one ink reservoir and multiple ink channels;

f) forming one of (i) a key element on said channel plate and a cooperative keyway element on said insulating layer, and (ii) a key element on said insulating layer and a cooperative keyway element on said channel plate and;

g) adhesively securing said channel plate to said substrate using said key element and said cooperative keyway element as an alignment aid to achieve proper positioning of said ink channels relative to said heating elements.

2. The method of claim 1 wherein said substrate is comprised of silicon.

3. The method of claim 1 wherein said insulating layer is comprised of polyimide.

4. The method of claim 1 wherein said treating comprises photopatterning.

5. The method of claim 1 wherein said ink channel plate is comprised of plastic.

6. The method of claim 1 wherein said key and an additional key are located on opposed edges of said ink channel plate and form overhanging members with sidewalls of said substrate.

7. The method of claim 1 wherein said adhesively secured first substrate and channel plate are diced to form multiple smaller printhead units.

8. The method of claim 1 wherein said key is formed on said channel plate and said keyway is formed in the insulating layer on said substrate.

9. The method of claim 1 wherein said key comprises a linear ridge and said keyway comprises a linear channel.

* * * * *